US008714494B2

(12) United States Patent
Weber

(10) Patent No.: US 8,714,494 B2
(45) Date of Patent: May 6, 2014

(54) RAILWAY TRAIN CRITICAL SYSTEMS HAVING CONTROL SYSTEM REDUNDANCY AND ASYMMETRIC COMMUNICATIONS CAPABILITY

(75) Inventor: Claus Weber, Eastchester, NY (US)

(73) Assignee: Siemens Industry, Inc., Alpharetta, GA (US)

( * ) Notice: Subject to any disclaimer, the term of this patent is extended or adjusted under 35 U.S.C. 154(b) by 68 days.

(21) Appl. No.: 13/608,313

(22) Filed: Sep. 10, 2012

(65) Prior Publication Data

US 2014/0074327 A1 Mar. 13, 2014

(51) Int. Cl.
*B61L 19/00* (2006.01)

(52) U.S. Cl.
USPC ..... 246/131; 246/122 R; 246/133; 246/218; 700/2; 700/3; 700/4; 701/19; 701/20; 701/24

(58) Field of Classification Search
None
See application file for complete search history.

(56) References Cited

U.S. PATENT DOCUMENTS

| | | | | |
|---|---|---|---|---|
| 5,685,507 | A * | 11/1997 | Horst et al. | 246/187 A |
| 6,135,396 | A * | 10/2000 | Whitfield et al. | 246/182 R |
| 6,463,337 | B1 * | 10/2002 | Walker | 700/4 |
| 6,788,980 | B1 * | 9/2004 | Johnson | 700/1 |
| 7,020,532 | B2 * | 3/2006 | Johnson et al. | 700/89 |
| 7,328,369 | B2 * | 2/2008 | Manoni | 714/11 |
| 7,487,075 | B2 * | 2/2009 | Martin et al. | 703/13 |
| 7,577,502 | B1 * | 8/2009 | Henry et al. | 701/19 |
| 7,966,126 | B2 * | 6/2011 | Willis et al. | 701/412 |
| 8,028,961 | B2 * | 10/2011 | Ashraf et al. | 246/167 R |
| 8,069,367 | B2 * | 11/2011 | Golowner et al. | 714/11 |
| 8,200,380 | B2 * | 6/2012 | Ghaly | 701/19 |
| 8,214,092 | B2 * | 7/2012 | Ghaly | 701/19 |
| 8,228,946 | B2 * | 7/2012 | Hao et al. | 370/469 |
| 8,407,512 | B2 * | 3/2013 | Kydles et al. | 713/500 |
| 8,469,319 | B2 * | 6/2013 | Kiss et al. | 246/125 |
| 8,469,320 | B2 * | 6/2013 | Baldwin et al. | 246/130 |
| 8,549,352 | B2 * | 10/2013 | Kranz et al. | 714/10 |
| 2005/0223288 | A1 * | 10/2005 | Berbaum et al. | 714/29 |
| 2005/0223290 | A1 * | 10/2005 | Berbaum et al. | 714/30 |
| 2007/0033511 | A1 * | 2/2007 | Davies | 714/799 |
| 2007/0240028 | A1 * | 10/2007 | Davies | 714/799 |
| 2009/0184210 | A1 * | 7/2009 | Groves et al. | 246/3 |
| 2010/0312461 | A1 * | 12/2010 | Haynie et al. | 701/117 |
| 2011/0238239 | A1 * | 9/2011 | Shuler et al. | 701/3 |
| 2012/0030524 | A1 * | 2/2012 | Schmid et al. | 714/49 |
| 2013/0060526 | A1 * | 3/2013 | Geiger et al. | 702/186 |
| 2013/0170498 | A1 * | 7/2013 | Danielsson et al. | 370/400 |
| 2013/0254442 | A1 * | 9/2013 | Robillard et al. | 710/107 |
| 2013/0277506 | A1 * | 10/2013 | Baldwin et al. | 246/473.1 |
| 2013/0339755 | A1 * | 12/2013 | Gallois et al. | 713/190 |

* cited by examiner

*Primary Examiner* — Thomas Tarcza
*Assistant Examiner* — Richard Goldman

(57) ABSTRACT

A railway vital or critical application system substitutes commercial off-the-shelf (COTS) hardware and/or software for railway-domain specific product components, yet is validated to conform with railway vital system failure-free standards. The vital system uses a pair of COTS personal computers and operating systems with asymmetric communications capability. Each computer and operating system may differ for additional redundancy. Both computers receive and verify vital systems input message data and security code integrity and separately generate output data responsive to the input message. The first computer has sole capability to send vital system output messages including the output data and an output security code, but only the second computer has the capability of generating the output security code. A failure of either computer's hardware, software or processing capability results failure to transmit a vital system output message or an output message that cannot be verified by other vital systems.

20 Claims, 6 Drawing Sheets

RAILWAY TRAIN CRITICAL SYSTEMS HAVING CONTROL SYSTEM REDUNDANCY AND ASYMMETRIC COMMUNICATIONS CAPABILITY

BACKGROUND OF THE DISCLOSURE

1. Field of the Invention

The invention relates to railway control critical or vital systems. More particularly, the present invention relates to control systems in railway critical or vital application systems with low hazard rates, as is needed in the railway industry. Railway vital application systems ("vital systems") include by way of non-limiting example train management systems, onboard units for automatic intervention if a train exceeds safeguarded speed limits, data recorders that record operational information, train speed and position determination equipment, brake and throttle control, sub-system status and diagnostics, wireless data communications exchanged between trackside/landside and train side (e.g., via wireless radio communications) and train crew communications. As used herein, the term "train" is a locomotive alone, locomotive with cars, or an integrated locomotive/car vehicle, (e.g., light rail or subway).

2. Description of the Prior Art

Railway trains are equipped with critical or vital systems that are required to have high availability and low hazard rates (a "hazard" is commonly understood as "physical situation with a potential for human injury and/or damage to environment" (IEC 62278)). Rail way operators and governmental regulators often require a hazard rate of no more than $10^{-9}$ per operational hour for a vital function (i.e., about one hazard per 114 thousand years of operation). Critical or vital systems are typically operated with electronic control systems. Over time those systems are gravitating to processor or controller operated digital electronic systems that communicate with each other over one or more communications data buses.

In order to meet railway safety objectives, control system hardware is often of proprietary dedicated design with documented testing and validation. Digital electronic controller operating systems and application software are also validated. Electronic data communications utilize validated security codes for data integrity checks, such as hash codes or cryptographic attachments, in order to assure data integrity upon transmission between the systems. Validation processes require time and expense. Given the relatively limited demand and sales volume of railway vital systems, as compared to demand for general commercial and consumer electronics (e.g., personal computer hardware, software and operating systems), the railway vital systems controllers and related equipment are expensive to manufacture and have longer product lifecycles than those sold in the general electronics applications fields.

However, consumer and commercial personal computers (PC's) cannot be directly substituted for existing railway vital systems control systems. PC's often only have a data failure rate of no more than 10 per operational hour, which is insufficient to meet railway systems required hazard rates of no more than $10^{-9}$ per operational hour. Additionally, PC commercial operating system software is not validated for use in railway vital systems.

There is a need in the railway industry to replace railway-domain specific proprietary design vital system control system hardware and operating system software with more readily available general purpose commercial off the shelf ("COTS") products, where feasible. Substitution of COTS subsystems for railway-domain specific proprietary design subsystems potentially can simplify overall system design, shorten system design cycles, and allow the railway vital system prime supplier to focus its efforts on overall system application and integration issues, where it has greater expertise than general consumer or COTS electronics sub-vendors.

There is also a need in the railway industry to reduce vital system control system procurement costs and increase the number of qualified sub-vendors by substituting COTS products for railway-domain specific products, when validation of the substitutes is cost effective. The railway customer and vital system prime supplier may also benefit from outsourcing design and manufacture of subsystem components to sub-vendors whom may have broader design expertise for their respective commercial components.

There is an additional need in the railway industry to streamline vital system procurement timelines by simplifying and aggregating validation procedures. For example, if commercial off-the-shelf (COTS) control system hardware and software components already meet recognized and documented reliability validation standards, there may be no need to revalidate those same products for railway critical system applications. Rather, the vital system validation may be consolidated and simplified by a general system validation process that includes contributions of already validated commercial off-the-shelf products, thereby streamlining procurement timelines and processes.

SUMMARY OF THE INVENTION

Accordingly, an object of the present invention is to simplify railway vital systems overall design by replacing proprietary design vital system control system hardware and operating system software with more readily available non-proprietary commercial products.

It is also an object of the present invention to reduce vital system control system procurement costs and increase the number of qualified sub-vendors whom may have broader design expertise in their respective commercial product lines by substituting non-proprietary products for proprietary products when validation for the substitutes is cost effective.

An additional object of the present invention is to streamline vital system control system procurement costs and validation timelines, as well as increase the number of qualified vendors by simplifying and aggregating validation procedures.

These and other objects are achieved in accordance with the present invention by a control system for a railway vital application system ("vital system") and method for operating that control system that substitutes commercial off-the-shelf hardware and operating system software for railway-domain specific proprietary product components, yet can be validated as in conformance with railway vital system standards. For example, a pair of commercial personal computers and operating systems may be substituted for proprietary railway-domain specific railway controllers and operating systems, and are configured for asymmetrical communication with other vital systems. Both computers receive and verify vital systems input message data and security code integrity and separately generate output data responsive to the input message. With an asymmetrical communication architecture, the first computer or other type of off-the-shelf controller has sole capability to send vital system output messages including the output data but without output security code, and only the second computer/controller has the capability of generating the needed output security code. Due to redundancy and asymmetrical communications architecture, a failure of either or both controller's hardware, software or processing capability results in failure to transmit a vital system output message or an output message that cannot be verified (and thus not used or trusted) by other vital systems that receive those unverified messages.

The present invention features a control system for a railway vital application system ("vital system"). The control system has a first controller having an external bilateral communications interface capable of sending and receiving a vital systems message that is generated within a railway vital application system. That message includes a security code and vital data. The control system also has a second controller with an external communications interface capable of receiving but incapable of sending a vital systems message that is generated within the second controller. The second controller has a security code generator. The control system has an inter-controller communications pathway coupling the first and second controllers. When operating the control system of the present invention the first and second controllers respectively receive an input vital systems message including input vital systems data and an input security code. They both verify the input message integrity and generate output vital systems data. The second controller generates an output security code and sends it to the first controller. Then the first controller sends an output vital systems message including the output vital systems data and the second controller's output security code for use within the vital application system.

The present invention also features a railway comprising a plurality of control systems for controlling railway vital systems. The control systems are communicatively coupled to each other for receipt and transmission of vital systems messages respectively having vital data and a security code. At least some of the respective control systems each have a first controller having an external bilateral communications interface capable of sending and receiving a vital systems message that is generated within another connected system. Those respective control systems also have a second controller having an external communications interface capable of receiving but incapable of sending a vital systems message that is generated within this second controller. The second controller has a security code generator. An inter-controller communications pathway couples the first and second controllers. In operation of those respective control systems the first and second controllers respectively receive an input vital systems message including input vital systems data and an input security code; verify the input message integrity and generate output vital systems data. The second controller generates an output security code and sends it to the first controller, and the first controller sends an output vital systems message including the output vital systems data and the second controller's output security code, for use within the connected system.

The present invention additionally features a method for controlling vital railway control systems (such as interlocking systems or train control systems). The method comprises receiving with respective first and second controllers a vital systems input message that is generated within a railway train that includes a security code and vital data, and independently verifying the input message integrity. Next each of the controllers independently generates output vital systems data in response to the input message. The second controller generates an output security code that is sent to the first controller, which is in turn then responsible for assembling, verifying and sending an output vital systems message including the output vital systems data and the second controller's output security code.

The objects and features of the present invention may be applied jointly or severally in any combination or sub-combination by those skilled in the art.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of the present invention can be readily utilized in a railway vital or critical system that substitutes commercial hardware and/or operating system software for proprietary product components, yet is validated to conform with railway vital system standards. In some embodiments of the present invention the vital system utilizes a pair of commercial personal computers and operating systems, or other commercially available controllers and operating systems. Each computer and operating system may differ for additional diversity. Both computers receive and verify vital systems input message data and security code integrity and separately generate output data responsive to the input message. The separate paired computers communicate asymmetrically. The first computer has sole capability to send vital system output messages, including the output data and an output security code, but only the second computer has the capability of generating the output security code. A failure of either computer hardware, software or processing capability results failure to transmit a vital system output message or transmits an output message that cannot be verified (and thus not used or trusted) by other vital systems that receive those unverified messages.

General Description of Train Critical or Vital Systems

Figure 1:
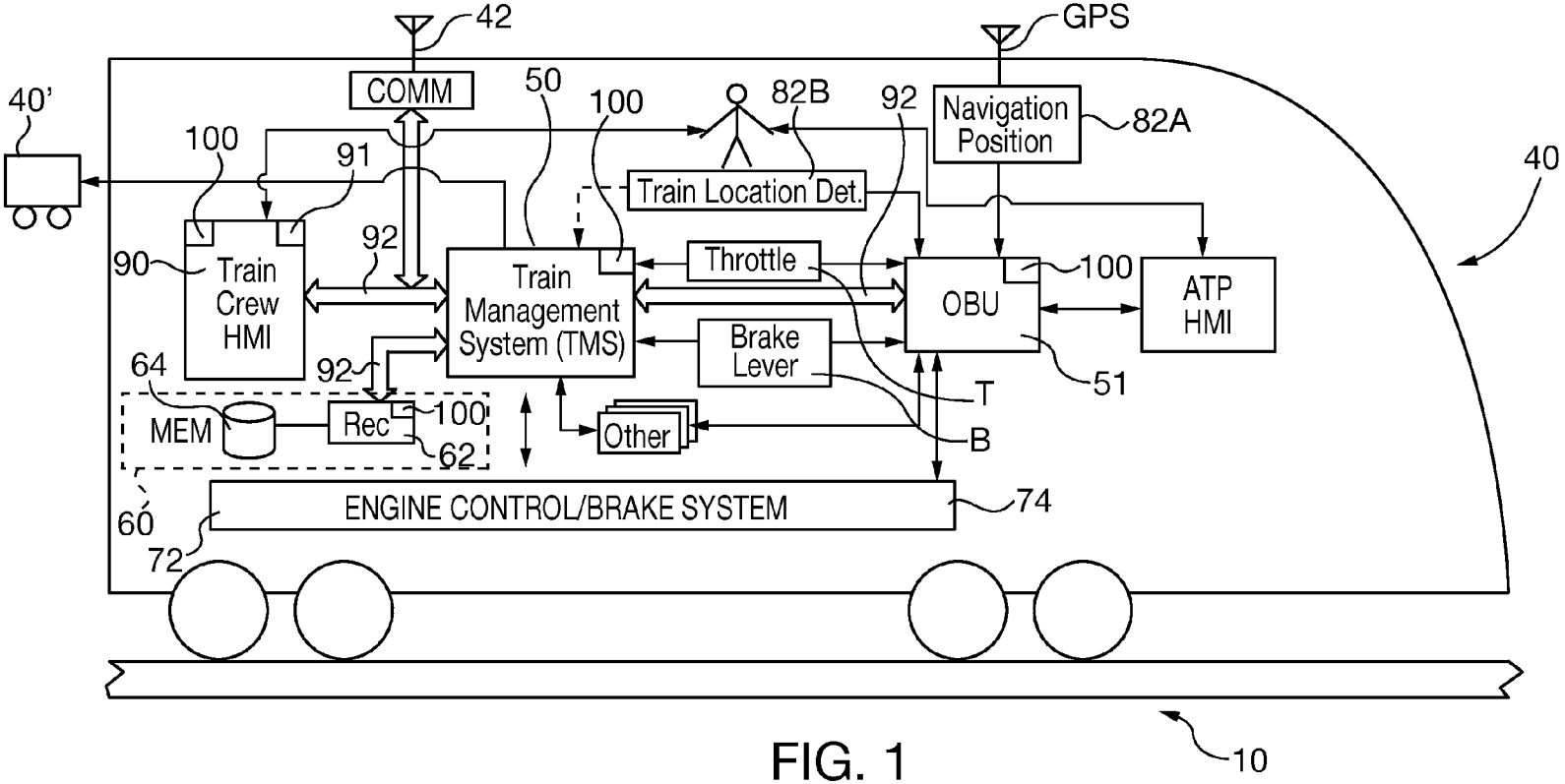
FIG. 1 is an onboard train control system general schematic drawing showing interaction of train vital or critical systems of the present invention.

FIG. 1 shows generally a railway system with fixed tracks 10 and one or more trains 40. The general description herein concerning train communications, interactions of train systems including vital or critical systems or the like, is of a general nature to assist in understanding how the present invention may be utilized in a railway train. Individual train networks and train systems may vary from the general exemplary description set forth herein. The train 40 includes a wireless data/communications system 42 that is capable of transmitting and receiving wireless data, which is in communication with the communications system wireless track-train-control station network (not shown).

The train transmitter and receiver communications vital system 42 is communicatively coupled directly or indirectly to other critical or vital systems, including the onboard train management system (TMS) 50 and an onboard unit (OBU) 51 that intervenes in train speed control and braking in the event that the train operator fails to follow local track speed and stopping mandates. Typically the train 40 also has an onboard data recording system (DRS) 60 of known design, with a recorder 62 and one or more associated memory storage devices 64, for among other things acquiring, processing, organizing, formatting and recording incident data. As with any other vital or critical system, the DRS 60 function may be incorporated as a subsystem within another train or board vital system, such as the train management system (TMS) 50, rather than as a separate stand-alone device.

As also shown in FIG. 1, train 40 generally has other vital or critical subsystems, including drive system 72 that provides driving force to one or more wheel carriages, and brake system 74 for altering train speed. The on-board train management system (TMS) 50 is the principal electronic control device for all other controlled train subsystems, including the navigation position system (NPS) 82A with associated train location detection system 82B that provides train position and speed information. Other subsystems include throttle control that causes the drive system 72 (e.g., more or less throttled speed) and receives commands from the TMS 50. The brake system 74 causes the brakes to brake the train 40. The brake system 74 also receives commands from the TMS 50. Other train cars and/or tandem locomotives 40' optionally may be in communication with the TMS 50 or other subsystems in train 40, such as for coordination of braking and throttle control. The train 40 also has a train crew human-machine interface (HMI) 90 that has an electronic display screen 91 and operator actuated brake B and throttle T controls (one or both of which are used by the operator depending upon the train operating conditions), so that the train operator can drive the train. The HMI 90 communicates with the TMS 50 via communications data bus 92, though other known communications pathways can be substituted for the data bus when implementing other known control system architectures. The HMI 90 communicates train operator respective throttle T and brake B control commands to the respective engine control 72 and the brake system 74.

In this exemplary embodiment of FIG. 1, each of the TMS train control system 50, the OBU 51, the data recording system (DRS) 60 and the HMI 90 have internal computer/controller platforms 100 of known design that communicate with each other via data bus 92. However the number of computer controllers, their location and their distributed functions may be altered as a matter of design choice. In this exemplary embodiment, general control of train 40 subsystems is performed by TMS 50 and the controller platform 100 therein; the intervention functions are performed by the OBU 51 and the controller platform 100 therein; the data recording functions are performed by the data recording system 60 and the controller platform 100 therein; and the HMI functions are performed by HMI 90 and the controller platform 100 therein, though any of these systems 50, 51, 60, 90 may be combined in part or in whole.

Figure 2:
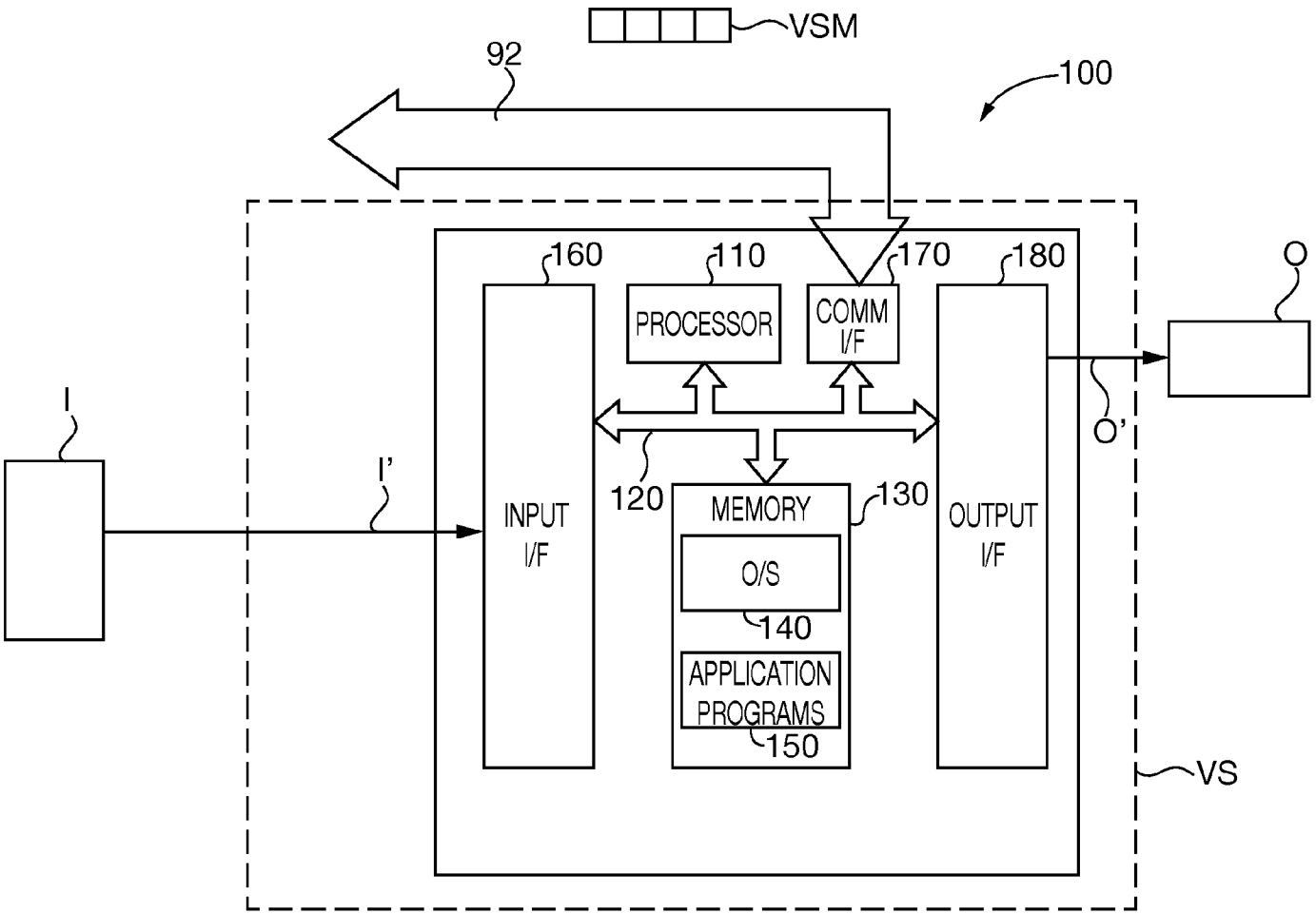
FIG. 2 is a schematic of a computer or controller of the type used in train vital system control systems of the present invention.

General Description of Vital or Critical Railway Systems Controller and Communication Referring to FIG. 2, a physical or virtual controller platform 100 includes a processor 110 and a controller bus 120 in communication therewith. Processor 110 is coupled to one or more internal or external memory devices 130 that include therein operating system 140 and application program 150 software module instruction sets that are accessed and executed by the processor, and cause its respective control device (e.g., TMS 50, OBU 51, DRS 60 or HMI 90, etc.) to perform control operations over their respective associated critical or vital subsystems.

While reference to an exemplary controller platform 100 architecture and implementation by software modules executed by the processor 110, it is also to be understood that the present invention may be implemented in various forms of hardware, software, firmware, special purpose processors, or a combination thereof. Preferably, aspects of the present invention are implemented in software as a program tangibly embodied on a program storage device. The program may be uploaded to, and executed by, a machine comprising any suitable architecture. Preferably, the machine is implemented on a computer platform having hardware such as one or more central processing units (CPU), a random access memory (RAM), and input/output (I/O) interface (s). The computer platform 100 also includes an operating system and microinstruction code. The various processes and functions described herein may either be part of the microinstruction code or part of the program (or combination thereof) which is executed via the operating system. In addition, various other peripheral devices may be connected to the computer/controller platform 100.

It is to be understood that, because some of the constituent system components and method steps depicted in the accompanying figures are preferably implemented in software, the actual connections between the system components (or the process steps) may differ depending upon the manner in which the present invention is programmed. Specifically, any of the computer platforms or devices may be interconnected using any existing or later-discovered networking technology and may also all be connected through a larger network system, such as a corporate network, metropolitan network or a global network, such as the Internet.

Computer/controller platform 100 receives input communications from one or more input devices I via respective communications pathways I' through input interface 160, that in turn can distribute the input information via the controller bus 120. Output interface 180 facilitates communication with one or more output devices O via associated communications pathways O' The controller platform 100 also has a communications interface 170 for communication with other controllers on a shared external data bus, such as the data bus 92 that was previously described.

Figure 3:
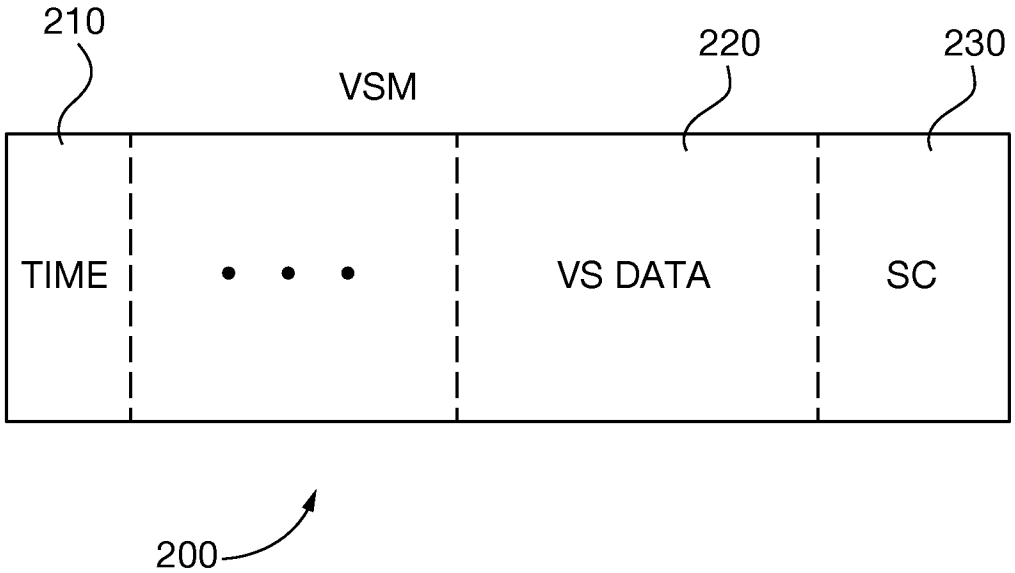
FIG. 3 is an exemplary vital systems message format used in the vital system control systems of the present invention.
Figure 4:
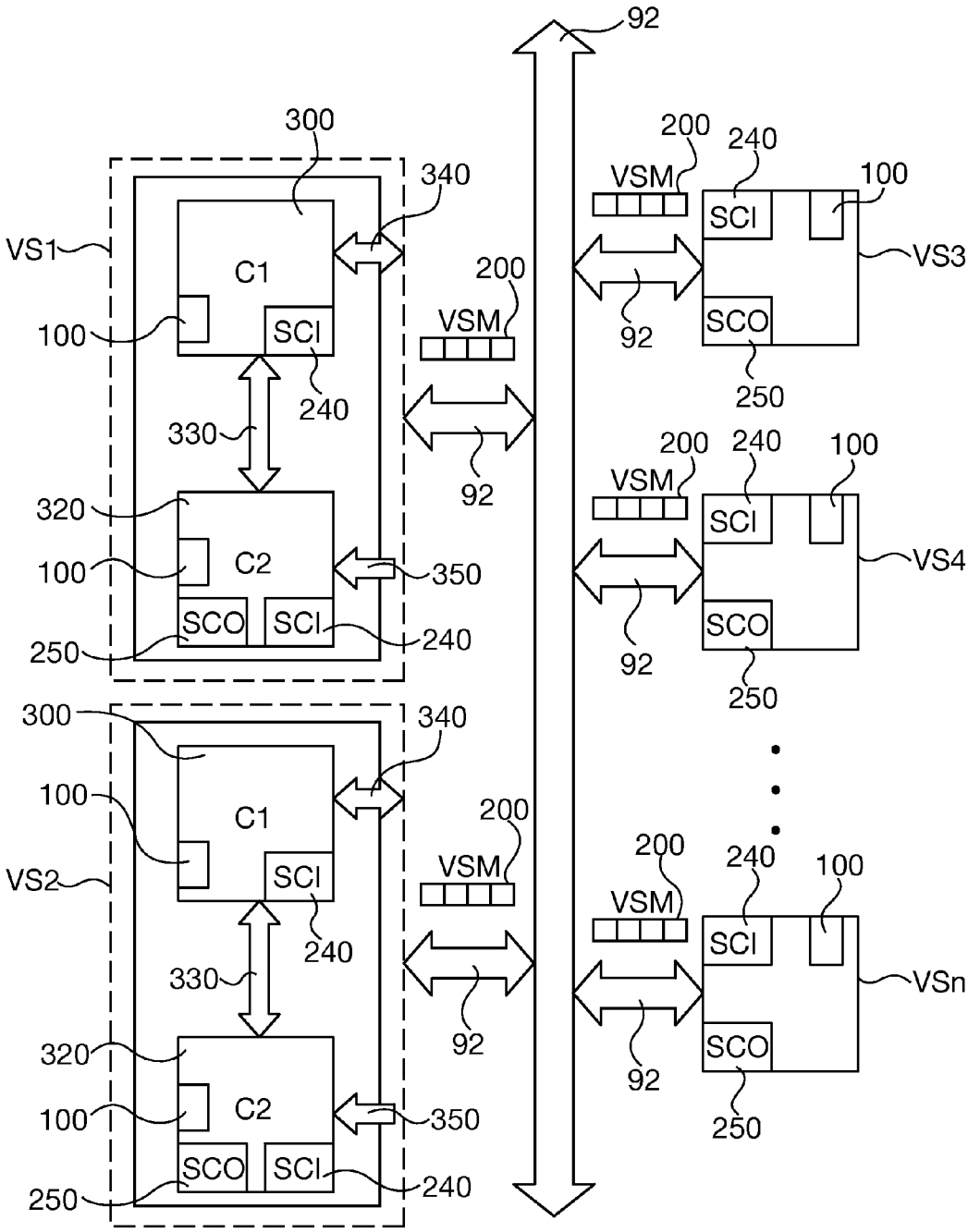
FIG. 4 is a block diagram showing communications interaction among the vital system control systems of the present invention.

Referring go FIGS. 2-4, communications among computer/controller platforms 100 and their respective critical or vital systems (VS1-VSn) are accomplished via a vital systems message (VSM) 200 carried on data bus 92. Each VSM 200 is formatted and transmitted in accordance with a known protocol that is approved for vital data integrity in railway critical systems, including a known security code generated by known CHECK-SUM, HASH, etc. protocols. The exemplary VSM 200 shown in FIG. 3 includes a time stamp 210, and if required a sequence number and source and destination identifiers (not shown), vital or critical system data (VS data) 220 and a security code (SC) 230. For ease of description herein, an incoming or input vital systems message (VSMI) comprises critical input data (DI) and an input security code (SI). Similarly, an outgoing or output vital systems message (VSMO) comprises critical output data (DO) and an output security code (SO) When a vital or critical system VS1-VSn receives a VSMI its data integrity is verified with a known SCI 240 analysis module within the controller that may be implemented in; hardware, firmware, software or any combination thereof. If the VSMI data integrity is verified the DI are utilized by the controller to prepare a responsive output message VSMO including output data DO and an output security code generated in SCO 250 generation module. As with the SCI 240 module the SCO 250 module generation function may be implemented in hardware, firmware, software or any combination thereof. The subsequently generated VSMO is communicated to one or more intended recipient VS controller platforms that in turn treat the message as a VSMI.

Redundant Control System and Operation

In FIG. 4 the vital system controllers VS1 and VS2 respectively comprise a paired set of controllers C1 300 and C2 320 that are in bilateral communication with each other via inter-controller data bus 330. The controllers 300, 320 are commercially available industrial, commercial or consumer devices, such as for example industrial programmable logic controllers, separate or unitized computer/controller motherboards or commercial off-the-shelf personal computers/motherboards. By way of further example if the controllers 300, 320 are personal computers they may be housed in separate devices, combined in a common device housing, may be separate boards in a server rack, etc. Each computer may comprise different hardware including controller platforms 100, and/or processors 110 and/or operating systems 140 and/or applications programs 150 stored therein that are executed by the processor to perform the its dedicated vital system function. The components and software in each respective computer 300, 320 may be sourced from different vendors. For example, each computer 300, 320 may include different vendor models, versions or types of processors 110, operating systems 140 and application software 150, so as to reduce potential of a generalized vendor-wide component or software failure.

The C1 computer 300 is capable of bilateral communication with the critical system data bus 92 through communications pathway 340, that may comprise a communications port enabled in the controller platform 100 communications interface 170. Computer 300 has an incoming security code verification module 240 that enables it to verify data integrity of a VSMI, but it does not have the capability of generating an outgoing VSMO security code SCO.

The C2 computer 320 has an enabled outgoing security code SCO generator 250, but is incapable of transmitting an SCO and critical output data directly to the critical system data bus 92. Computer 320 is only able to transmit the SCO to computer 300 via the internal data bus 330: it is only capable of receiving a VSMI through unilateral, incoming communications pathway 350 and can verify data integrity with SCI verification module 240. In other words, the C2 computer 320 is incapable of transmitting directly VSMO to the data bus 92.

Figure 5:
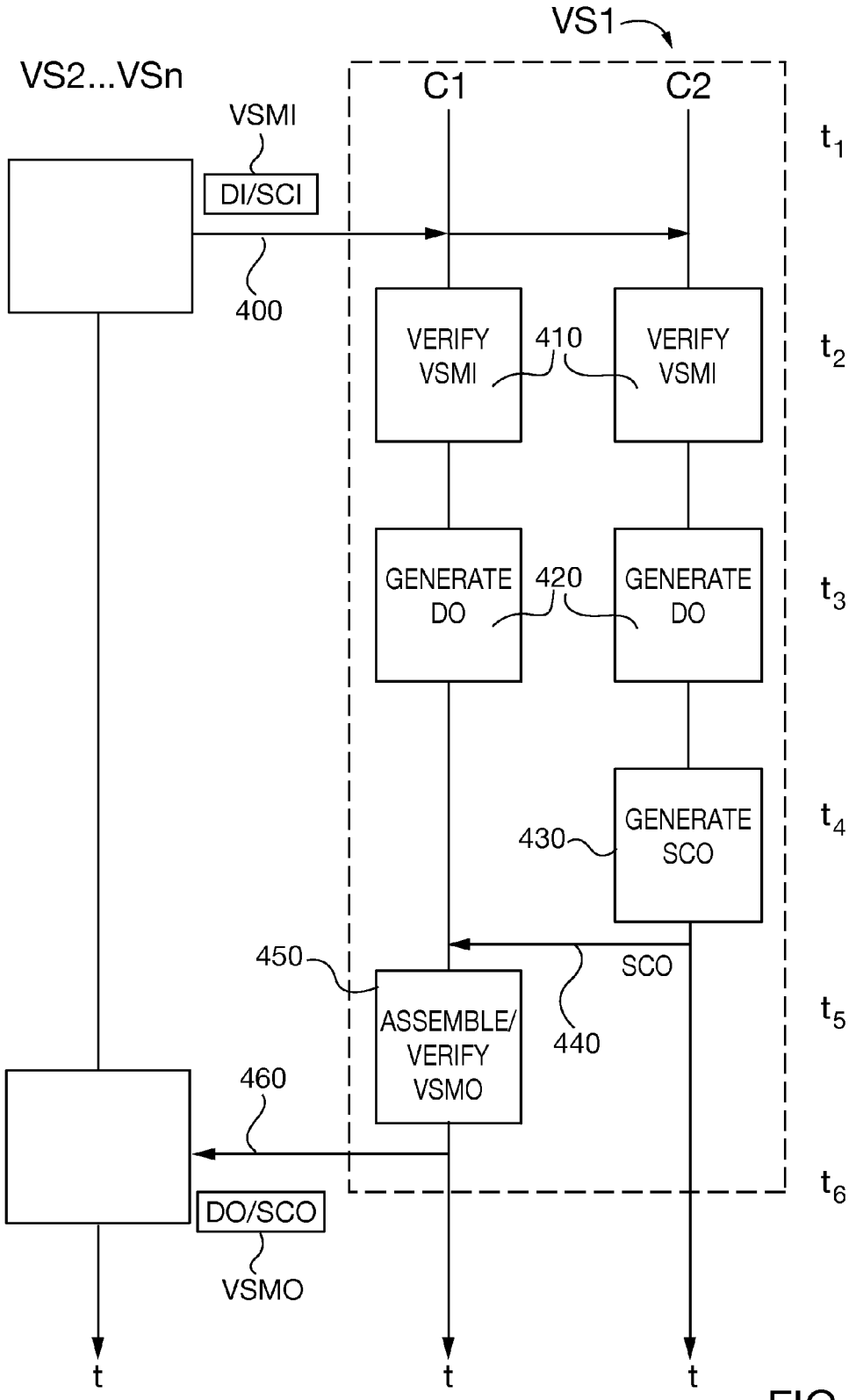
FIG. 5 is a timing diagram showing processing steps performed by an exemplary embodiment of the vital system control systems of the present invention.
Figure 6:
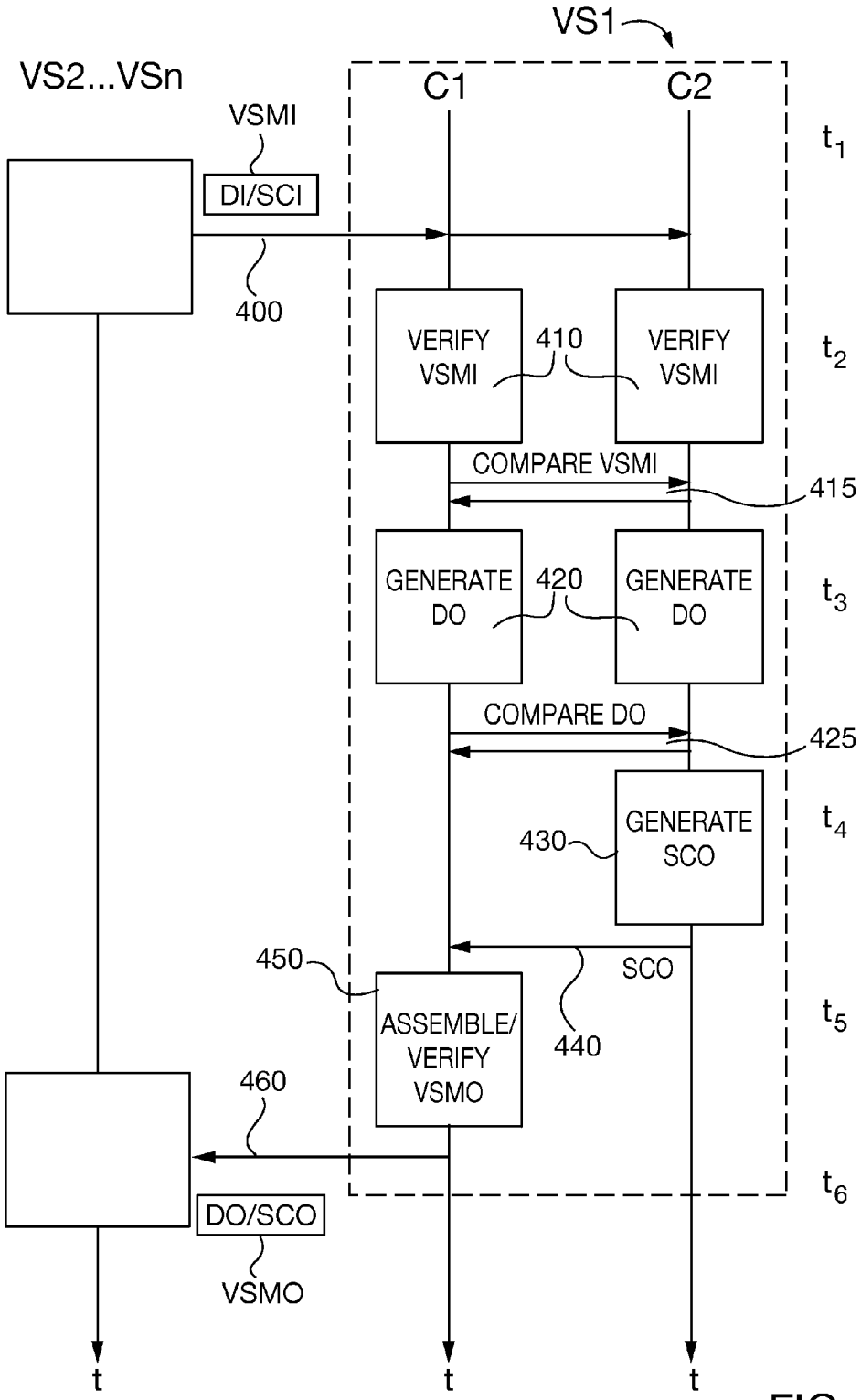
FIG. 6 is a timing diagram showing processing steps performed by another exemplary embodiment of the vital system control systems of the present invention.

As can be understood by reference to FIGS. 5 and 6, the respective C1 computer 300 and C2 computer 320 in VS1 are in a mutually dependent, paired relationship with asymmetric communications implementations. The first C1 computer 300 is capable of receiving a VSMI and sending a responsive VSMO, but it cannot create the responsive message until it receives the SCO from the second C2 computer 320. The C2 computer is not capable of external communication to the critical system data bus 92, and must rely on the C1 computer to send any messages.

in FIG. 5, one of the vital systems VS2-VSn is sending a VSMI in step 400, comprising a DI and an SCI to VS1 at time $t_1$, where it is received by both C1 and C2. At $t_2$, both C1 and C2 verify the VSMI data integrity in step 410 and in step 420 both generate DO data ($t_3$) in response to the input data DI. In step 430 C2 generates the output security code SCO at time to and sends it to C1 in step 440 in step 450 ($t_5$), C1 now assembles and optionally verifies the DO (provided by C2 in the prior step) with its own generated DO before transmitting the VSMO through critical systems data bus 92 in step 460 ($t_6$) to other vital or critical systems. If the DO do not corroborate each other during step 450 (i.e., output data is suspect) it will not transmit the VSMO. Alternatively, if C1 is not enabled to verify the DO or if C1 and/or C2 is malfunctioning, it may transmit a corrupted VSMO, but the corruption will be identified when the message is received by another vital system.

The embodiment of FIG. 6 has all of the steps and processes as the embodiment of FIG. 5, but adds a compare VSMI verification step 415, where C1 and C2 check each other's respective verification results. If the compared results are not the same VS1 flags a fault. This embodiment also adds a compare output data DO step 425 before C2 generates the security output code SCO in step 430. Again, if the compared results are not the same VS1 flags a fault.

The hardware/software redundancy and mutually dependent asymmetric communication output security code generation/transmission features of the present invention railway control system for critical systems assures a higher safety level than any individual or independently parallel processing pair of commercial off-the-shelf controllers or personal computers. A single computer is susceptible to multiple forms of failure that would not necessarily be detected by other vital systems receiving VSMOs from the failing computer. Two independent, parallel computers feeding identical VSMOs to other critical systems or that corroborate output messages prior to transmission can both be generating identical incorrect output messages. Such failure mode transmission errors are not possible with the control system of the present invention.

When analyzing possible failure modes of the critical systems control system of the present invention VS1, if C1 calculates an incorrect DO and C2 calculates a correct DO and SCO, then during verification step 450 C1 will flag a mismatch between its own DO and the DO and flag an error. If C1 does not verify the VSMO in step 450 other vital systems receiving that message will flag the error when they verify the received message. Conversely if the C1 DO is correct but either the C2 DO or SCO are incorrect, C2 or other VS receiving the VSMO will identify the error. If both C1 and C2 malfunction and generate faulty DO and/or SCO the mismatch of the DO and SCO will be noted by other critical systems that subsequently receive the corrupted message.

Although various embodiments which incorporate the teachings of the present invention have been shown and described in detail herein, those skilled in the art can readily devise many other varied embodiments that still incorporate these teachings.

What is claimed is:

1. A control system for a railway vital application system, comprising:

a first controller having an external bilateral communications interface capable of sending and receiving a vital systems message within a railway vital application system, the message including a security code and vital data;

a second controller having an external communications interface capable of receiving a vital systems message, but incapable of sending a vital systems message that is generated within the second controller, the second controller having a security code generator; and an inter-controller communications pathway coupling the first and second controllers;

wherein the first and second controllers respectively receive an input vital systems message including input vital systems data and an input security code, verify the input message integrity and generate output vital systems data, the second controller generates an output security code and sends it to the first controller, and the first controller sends an output vital systems message including the output vital systems data and the second controller output security code for use within the railway vital application system.

2. The system of claim 1, wherein the first and second controllers compare their respective input message integrity verifications prior to generating respective output vital systems data.

3. The system of claim 2, wherein the first and second controllers compare their respective output vital systems data.

4. The system of claim 3, wherein the first and second controllers compare their respective output vital systems data prior to generation of the output security code.

5. The system of claim 1, wherein the first controller verifies output vital systems data integrity before sending the output vital systems message.

6. The system of claim 1, wherein the first and second controllers comprise personal computers selected from the group consisting of respectively having at least one of different microprocessors, operating systems or software instruction sets.

7. The system of claim 1 wherein the functions of at least one of the controllers is virtually simulated.

8. A railway vital application system comprising the control system of claim 1.

9. A railway vital application system comprising the control system of claim 6.

10. A railway system comprising:

a plurality of control systems for controlling railway vital systems, the control systems communicatively coupled to each other for receipt and transmission of vital systems messages respectively having vital data and a security code, the respective control systems comprising:

a first controller having an external bilateral communications interface capable of sending and receiving a vital systems message that is generated within the railway system;

a second controller having an external communications interface capable of receiving a vital systems message, but incapable of sending a vital systems message that is generated within the second controller, the second controller having a security code generator; and an inter-controller communications pathway coupling the first and second controllers;

wherein the first and second controllers respectively receive an input vital systems message including input vital systems data and an input security code, verify the input message integrity and generate output vital systems data, the second controller generates an output security code and sends it to the first controller, and the first controller sends an output vital systems message including the output vital systems data and the second controller output security code, for use within the railway system.

11. The railway system of claim 10, wherein the first and second controllers compare their respective input message integrity verifications prior to generating respective output vital systems data.

12. The railway system of claim 11, wherein the first and second controllers compare their respective output vital systems data.

13. The railway system of claim 12, wherein the first and second controllers compare their respective output vital systems data prior to generation of the output security code.

14. The railway system of claim 10, wherein the first controller verifies output vital systems data integrity before sending the output vital systems message.

15. The railway system of claim 10, wherein within each respective control system the first and second controllers comprise personal computers selected from the group consisting of respectively having at least one of different microprocessors, operating systems or software instruction sets.

16. The railway train of claim 15, wherein each respective control system the computers have different hardware and different operating systems.

17. A method for controlling a railway vital application control system, comprising:

receiving with respective first and second controllers a vital systems input message that is generated within a railway vital application system that includes a security code and vital data, and independently verifying the input message integrity;

independently generating output vital systems data in response to the input message with the respective first and second controllers;

generating an output security code only with the second controller and sending the generated output security code to the first controller; and assembling and sending an output vital systems message including the output vital systems data and second controller output security code with the first controller.

18. The method of claim 17, further comprising comparing first and second controllers respective input message integrity verifications prior to generating respective output vital systems data.

19. The method of claim 18, further comprising comparing first and second controllers respective output vital systems data.

20. The method of claim 19, further comprising comparing first and second controllers respective output vital systems data prior to generating the output security code.

* * * * *